United States Patent [19]

Beam et al.

[11] Patent Number: 4,624,198

[45] Date of Patent: Nov. 25, 1986

[54] METHOD AND APPARATUS FOR FABRICATING PILLOWCASES WITH ATTACHED HEMS

[75] Inventors: Hoyt W. Beam, Concord; Gregory A. Ball, Mooresville; Byron E. Moore, Kannapolis, all of N.C.

[73] Assignee: Cannon Mills Company, Kannapolis, N.C.

[21] Appl. No.: 794,304

[22] Filed: Nov. 1, 1985

[51] Int. Cl.[4] ..... D05B 13/00

[52] U.S. Cl. ..... 112/10; 112/121.15; 112/121.29; 112/141; 112/262.3; 112/304; 112/121.11

[58] Field of Search ..... 112/10, 11, 121.11, 112/121.12, 121.15, 121.29, 121.26, 141, 153, 304, 307

[56] References Cited

U.S. PATENT DOCUMENTS

| | | | |
|---|---|---|---|
| 2,726,611 | 12/1955 | Cloutier . | |
| 3,013,513 | 12/1961 | Judelson . | |
| 3,126,848 | 3/1964 | Gastonguay . | |
| 3,203,386 | 8/1965 | Briggs . | |
| 3,224,394 | 12/1965 | Dobner et al. . | |
| 3,227,118 | 1/1966 | Gore . | |
| 3,227,119 | 1/1966 | Gore et al. . | |
| 3,277,851 | 10/1966 | Dobner et al. | 112/147 X |
| 3,640,235 | 2/1972 | Burton | 112/121.29 |
| 4,068,603 | 1/1978 | Arbter | 112/121.11 |
| 4,086,860 | 5/1978 | Kosrow et al. . | |
| 4,214,541 | 7/1980 | Zeigler, Jr. . | |
| 4,224,883 | 9/1980 | Zeigler, Jr. . | |
| 4,269,130 | 5/1981 | Burton et al. . | |
| 4,287,841 | 9/1981 | Rovin | 112/147 X |
| 4,292,908 | 10/1981 | Blessing . | |
| 4,353,316 | 10/1982 | Brocklehurst . | |
| 4,388,879 | 6/1983 | Everall, Jr. . | |
| 4,462,322 | 7/1984 | Brocklehurst . | |

*Primary Examiner*—H. Hampton Hunter

*Attorney, Agent, or Firm*—Bell, Seltzer, Park & Gibson

[57] ABSTRACT

A method and apparatus for successively fabricating pillowcases from a continuous open width textile fabric and in which the leading end portion of the textile fabric is folded over onto an adjacent trailing portion before the fabric is transversely cut. The folding of the leading end portion of the textile fabric over and above the adjacent trailing portion provides positive and accurate control and positioning of the corresponding edges of the upper and lower layers of the pillowcase blank. This accurate alignment of the edges of the upper and lower layers of the pillowcase blank is maintained while respective side and bottom seams are formed along the corresponding edges of the pillowcase blank.

11 Claims, 6 Drawing Figures

METHOD AND APPARATUS FOR FABRICATING PILLOWCASES WITH ATTACHED HEMS

FIELD OF THE INVENTION

This invention relates generally to a method and apparatus for fabricating pillowcases and the like with attached hems, and more particularly to such a method and apparatus for automatically fabricating successive pillowcases with the upper layer being folded into accurate overlying relationship with the lower layer prior to the cutting of the open width textile fabric so that each successive pillowcase blank is identical and with properly aligned top, side and bottom edges.

BACKGROUND OF THE INVENTION

It is generally known to automatically fabricate pillowcases with attached hems. For example, U.S. Pat. Nos. 4,214,541 and 4,224,883 disclose an apparatus for automatically fabricating successive pillowcases with attached hems. In the apparatus disclosed in these patents, open width textile fabric is withdrawn from a supply source and a relatively narrow width of fabric is longitudinally folded and sewn to one edge of the open width fabric to continuously attach the hem along one side thereof. The open width fabric, with the hem attached, is then transversely cut in predetermined lengths to form the individual pillowcase blanks. The individual cut blanks are then folded along a transversely extending fold line in the medial portion between the cut edges with the adjacent layers of the pillowcase positioned in a substantially vertical position hanging down from a folding bar supporting the pillowcase blank along the transverse fold line. The folded pillowcase blank is moved from this substantially vertical position by grippers which pick up the upper end of the vertically extending pillowcase blank along the fold line and move the same in a horizontal direction and spread the pillowcase blank in a horizontal position across a conveyor for transporting the pillowcase blank to the side and bottom seaming operations The cutting of the textile fabric before the folding operation makes it difficult to accurately align the edges of the pillowcase fabric during the folding operation. Also, the grippers used in moving the folded pillowcase blank from the substantially vertical position to the horizontal position may fail to properly grip the pillowcase blank along the fold line and thus cause an interruption of the production of the pillowcase forming apparatus.

OBJECT AND SUMMARY OF THE INVENTION

With the foregoing in mind, it is an object of the present invention to provide a method and apparatus in which the leading end of the textile fabric is transversely folded over onto an adjacent trailing portion to form superposed upper and lower layers before the fabric is transversely cut to form the individual pillowcase blanks so that accurate alignment of the edges of the upper and lower layers of the pillowcase blank is accomplished before the pillowcase blank is separated from the continuous length textile fabric.

In accordance with the present invention, the leading end portion of the textile fabric is folded over and onto the trailing adjacent portion while the trailing adjacent portion is firmly clamped in a fixed position. The folding over of the leading end portion of the fabric is accomplished by means of a movable folding plate which is operable to position the edges of the upper layer of the pillowcase blank in accurate alignment with the corresponding edges of the lower layer of the adjacent trailing portion of the textile fabric. This folding of the textile fabric is completed prior to the transverse cutting of the textile fabric along a line parallel to and adjacent the leading end of the upper layer of the pillowcase blank. The accurately folded pillowcase blank is then moved through a side seaming station and a bottom end seaming station and finally stacked in successive stacks at a counting and stacking station The improved folding station of the present apparatus provides for the accurate and concise folding of the leading portion of the textile fabric over onto the adjacent trailing end portion before the pillowcase blank is severed from the remaining portion of the textile fabric so that the upper layer of the pillowcase blank is properly aligned with the corresponding edges of the lower layer of the pillowcase blank. The folding station includes conveying means for moving the leading end of the textile fabric to a position located a predetermined distance beyond the cutting station and a clamping plate for engaging and maintaining the trailing adjacent portion of the textile fabric in a flat and stationary condition. A folding plate is positioned downstream of the clamping plate and is operated to move the leading end portion of the textile fabric over onto the clamping plate and above the adjacent trailing portion. This folding operation positions the upper layer in a flat condition with the edges properly aligned with the corresponding edges of the lower layer of the pillowcase blank. The clamping and folding plates maintain the upper and lower layers in this accurately aligned condition while the lower layer is cut along a line extending transversely of the textile fabric and parallel with the leading end of the upper layer of the pillowcase blank. The folded pillowcase blank is then withdrawn over one end of the clamping plate and moved through successive side and bottom end seaming stations to complete the fabrication of the pillowcase.

BRIEF DESCRIPTION OF THE DRAWINGS

Some of the objects and advantages of the present invention having been set forth, other objects and advantages will appear as the description proceeds when taken in connection with the accompanying drawings, in which—

DESCRIPTION OF THE ILLUSTRATED EMBODIMENT

The method and apparatus of the present invention is somewhat similar to the pillowcase fabricating apparatus illustrated in copending patent application Ser. No. 776,651 , filed Sept. 16, 1985, and assigned to the assignee of the present application. In the apparatus of the copending application, the open width textile fabric is first cut into predetermined lengths to form individual pillowcase blanks and the blank is then folded by initially moving the same in a vertical direction and engaging the vertically extending portion with a horizontally movable folding bar so that the upper and lower layers of the pillowcase blank are moved into a horizontally aligned position.

The apparatus of the present invention differs from the disclosure of the copending application primarily in that the folding of the pillowcase blank takes place and is completed before the pillowcase blank is severed from the open width fabric. Also, the folding operation is accomplished by means of a clamping plate which moves into clamping position on the trailing adjacent portion of the textile fabric while a movable folding plate supports the leading end portion of the fabric. The folding plate then moves into position above the fixed clamping plate to fold the leading end portion back over the trailing adjacent portion so that the edges of the upper layer of the pillowcase blank are accurately aligned with the corresponding edges of the lower layer.

Certain of the operations and features of the apparatus of the present invention are the same as corresponding operations and features of the apparatus of the copending application. These common features will be briefly described in the present application and reference may be made to the copending application for details of these common features.

Figure 1:
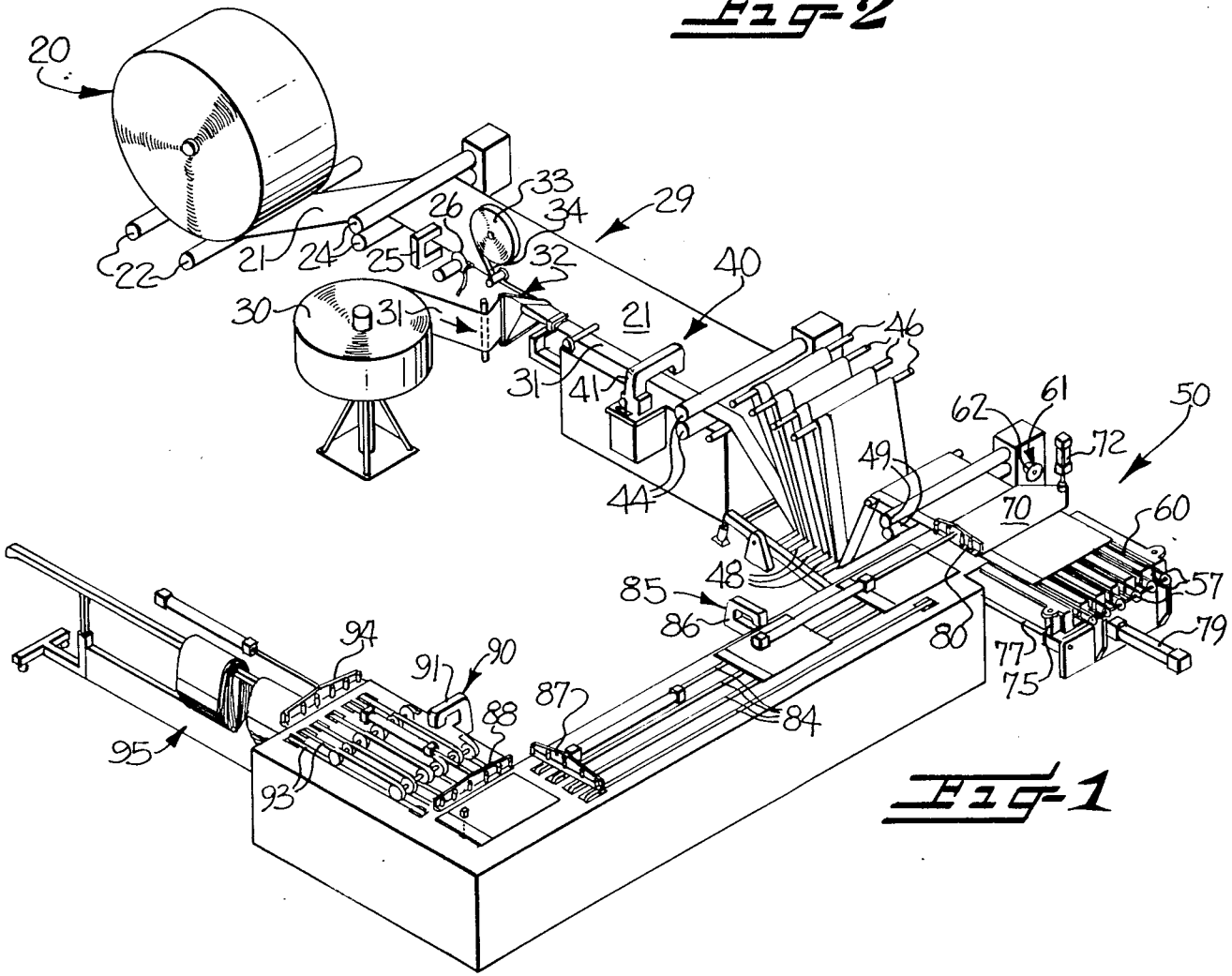
FIG. 1 is a somewhat schematic isometric view of the apparatus of the present invention.

As illustrated in FIG. 1, the apparatus of the present invention includes a supply source, broadly indicated at 20, illustrated as a roll of continuous open width textile fabric 21 with opposite side edges extending along opposite sides thereof. The supply roll of textile fabric 21 is supported for rotation in rotatable cradle rolls 22. Means is provided for withdrawing textile fabric 21 from the supply source 20 and along a first horizontal path of travel in a lengthwise direction. This fabric withdrawing means includes feed rolls 24 positioned adjacent the supply source 20 and being operable to withdraw the fabric 21 from the supply source 20.

As illustrated in FIG. 1, an edge sensing device 25 is supported adjacent one side edge of the textile fabric and may be operated in the usual manner to maintain the textile fabric moving in a predetermined longitudinal path of travel. A width trimming knife 26 is supported adjacent the side edge of the textile fabric for trimming the textile fabric to a particular width or for trimming the edge to eliminate any yarn ends extending therefrom, such as occurs when the fabric is woven on a shuttleless type loom.

A hem forming station, broadly indicated at 29, is provided downstream of the edge trimming knife 26 and includes a hem supply source, indicated as a rotatable supply spool 30 of relatively narrow width hem fabric 31. Suitable folding means, in the form of a folding guide, broadly indicated at 32, is provided for longitudinally folding the hem fabric as it is guided into position with the opposite edge portions being inwardly folded and positioned above and below one side edge of the pillowcase fabric 21 as the pillowcase fabric is traveling lengthwise along the first horizontal path of travel. It is to be understood that the folded hem fabric 31 can be of the same type as the pillowcase or it may be of a contrasting color and/or material.

Figure 2:
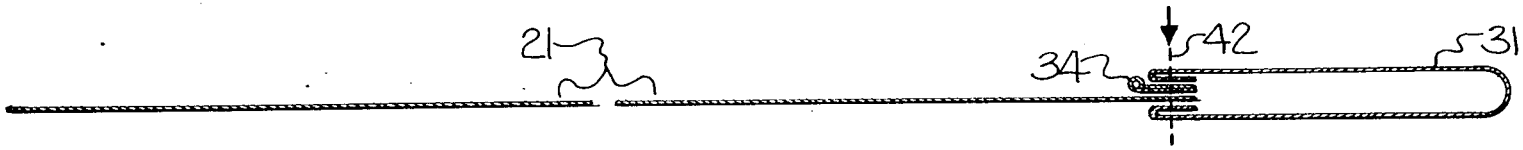
FIG. 2 is a transverse sectional view through the open width textile fabric and illustrating the manner in which the folded hem is attached along one side of the textile fabric and with an optional piping attached along one edge of the hem.

A piping supply spool 33 is supported for rotation for supplying a suitable piping material 34 to one side and along the lower edge of the folded hem material 31. The piping material may be in the form of a tape, decorative lace, or other suitable material which is fed along under the upper inwardly folded side edge of the wide hem material 31. The piping material 34 is positioned to be attached to the pillowcase fabric 21 at a hem stitching station, broadly indicated at 40. The hem stitching station 40 includes a sewing machine 41 which is adapted to form a line of stitching, indicated at 42 in FIG. 2, along the inwardly folded edges of the folded hem to attach the hem and the piping along one side edge of the textile fabric 21.

Fabric accumulator and tension means is positioned downstream of the hem stitching station 40 for receiving and maintaining predetermined tension in the fabric 21. The fabric accumulator and tension means includes an upper series of guide rolls 46 and a lower series of guide rolls 48 which are suitably supported for rotation at opposite ends on a suitable frame, not shown.

A set of feed rolls 44 is supported for driving engagement with the textile fabric 21 and immediately downstream of the hem stitching station 40. Suitable drive means is provided for the feed rolls 44 for maintaining the textile fabric 21 under the proper amount of tension while the fabric 21 is being passed through the hem forming station 29 and the hem stitching station 40.

An additional set of feed rolls 49 is positioned downstream of the accumulator and is suitably driven in timed relationship to operation of the other pillowcase forming functions of the apparatus for feeding the textile fabric 21 into the folding station, broadly indicated at 50. The leading end portion of the textile fabric 21 is fed across and above a guide plate 55 (FIG. 3) by the feed rolls 49 and onto the upper reach of conveyor belts 56 which extends throughout substantially the full width of the textile fabric 21. The leading end of the fabric 21 is then fed onto the upper reaches of a plurality of spaced-apart relatively narrow conveyor belts 57 which have their upper reaches extending through suitable elongate slots 58 in a movable folding plate 60.

Suitable detector means, not shown, may be provided for detecting and stopping the feeding of the leading end of the textile fabric 21 at a predetermined location beyond a transverse line defined as a cutting station, broadly indicated at 61, and including a rotatable cutter blade 62. When a predetermined length of the textile fabric 21 is fed into the folding station 50 by the conveyor belts 56, 57, the rotatable cutter blade 62 is positioned out of the path of travel of the textile fabric 21. The rotatable cutter blade 62 is supported on a carriage 64 mounted for sliding movement on guide rods 65 and is moved by a rodless air cylinder 66 from one side of the textile fabric to the other to transversely cut the fabric.

Figure 3:
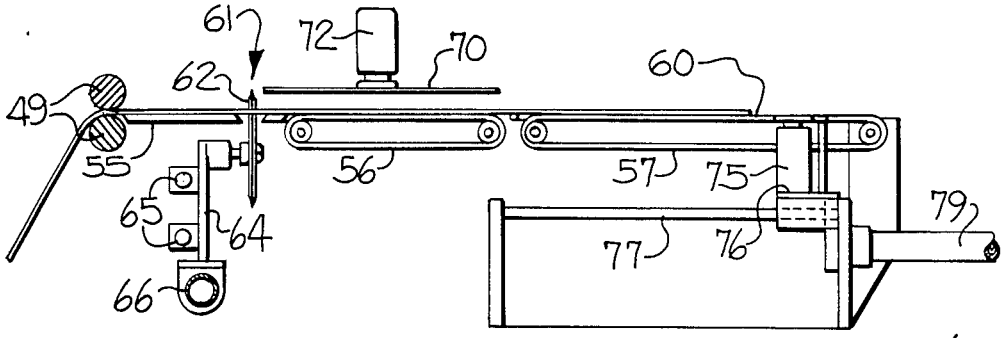
FIG. 3 is a somewhat schematic view of the folding station and illustrating the position of the textile fabric just prior to the first step in forming the folded pillowcase blank.
Figure 4:
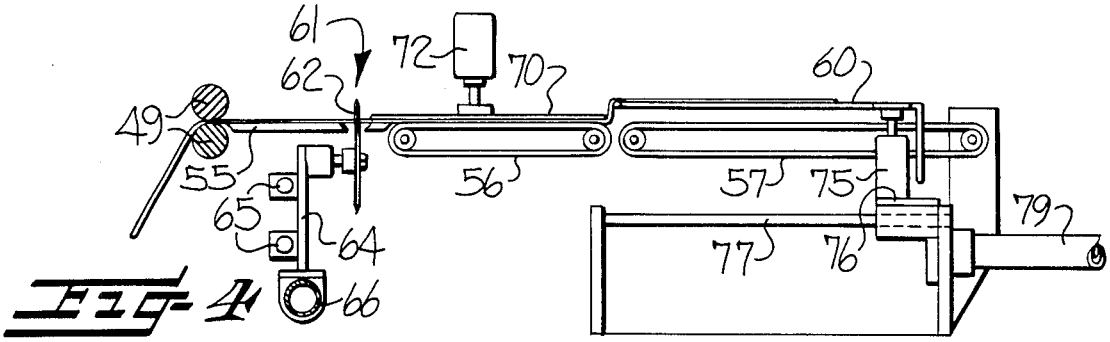
FIG. 4 is a view similar to FIG. 3 but showing the first step in the folding operation.
Figure 5:
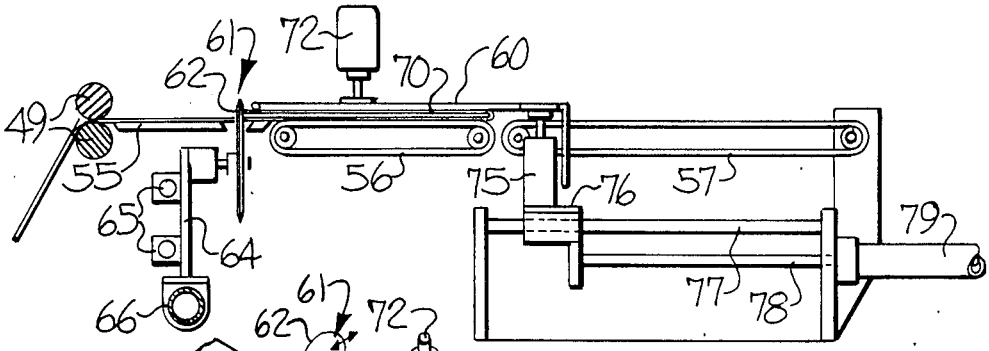
FIG. 5 is a view similar to FIGS. 3 and 4 but showing the pillowcase blank in folded condition and with the lower layer being severed from the textile fabric after the folding operation is completed.
Figure 6:
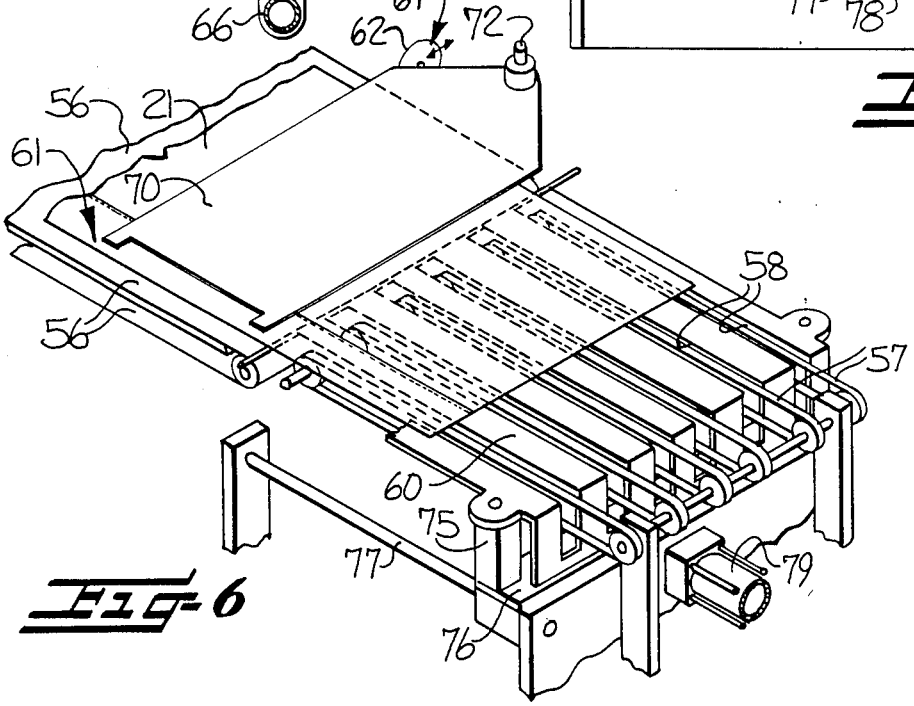
FIG. 6 is an isometric view of the folding plate and illustrating the conveyor belts positioned in elongated slots therein.

As the textile fabric 21 is guided onto the conveyor belt 56 and positioned as shown in FIG. 3, it is directed beneath a vertically movable clamping plate 70, one end of which is fixed on the lower end of a pneumatic operating cylinder 72. The clamping plate 70 is in the raised position shown in FIG. 3 when the textile fabric 21 is fed therebeneath and is then moved downwardly to clamp the adjacent trailing portion of the pillowcase fabric against the conveyor belt 56. When this trailing adjacent portion of the pillowcase fabric has been clamped by the vertically movable clamping plate 70, the movable folding plate 60 is raised upwardly a slight amount by first operating means so that it is positioned slightly above the upper level of the clamping plate 70, as shown in FIG. 4. The outer edge portion of the movable folding plate 60 is supported on the upper ends of the piston rods of spaced apart pneumatic operating cylinders 75, which form the first operating means for the folding plate 60. The lower ends of the cylinders 75 are suitably supported on a transverse support plate 76 which is in turn supported at opposite ends for horizontal sliding movement on guide rods 77. Second operating means is provided for horizontally moving the folding plate 60 into overlying relationship above the clamping plate 70, as shown in FIG. 5. The second operating means includes the end of a piston rod 78 (FIG. 5) of a pneumatic operating cylinder 79. The end of the piston rod 78 is fixed to the support plate 76 for imparting inward and outward movement to the folding plate 60.

After the movable folding plate 60 has been raised to a level slightly above the clamping plate 70, it is moved inwardly, as shown in FIG. 5, to fold the leading end portion of the textile fabric 21 transversely across and over the width of the pillowcase blank and onto the upper surface of the clamping plate 70. An upper layer of the pillowcase fabric is thus provided with the upper layer having its cut side aligned with the cutting line and with opposite ends aligned with the corresponding ends of the lower layer. The opposite sides of the upper and lower layers are joined together along a transverse fold line extending along one side of the pillowcase blank. After the folding of the pillowcase is completed, as illustrated in FIG. 5, the rotatable cutting blade 62 is moved across and cuts the width of the fabric 21 to separate the folded pillowcase blank and form the leading end of the next successive pillowcase blank.

Suitable conveying means, such as a conveyor rake member 80 (FIG. 1), which may be of the type shown in the copending application, is provided to initially withdraw the folded pillowcase blank over one end of the clamping plate 70, after the clamping plate 70 has been raised out of clamping relationship with the lower layer of the pillowcase blank. If desired, the cut side edges of the pillowcase blank may be moved in a lengthwise direction and through a corner aligning station, not shown. The corner aligning station may be of the type illustrated in the copending application, which operates to provide a differential travel between the side edges of the upper and lower layers of the pillowcase blank to align the corners therewith before the side edges are seamed together.

The pillowcase blank is conveyed in a lengthwise direction by conveyor belts 84 (FIG. 1) through a side seaming station, broadly indicated at 85. The side seaming station 85 includes a sewing machine 86 positioned to stitch together the aligned side edges of the upper and lower layers of the pillowcase blank as the pillowcase blank moves through the side seaming station. Suitable cutting means, not shown, is provided adjacent the sewing machine 86 to cut the stitch chain extending from the trailing edge of the pillowcase blank.

After completion of the sewing of the aligned side edges of the pillowcase blank, the pillowcase blank is moved to a position beyond the ends of the conveyor belts 84 by means of a conveyor rake member 87. A conveyor rake member 88 then moves the pillowcase blank in a widthwise direction and onto spaced apart conveyor belts 93 which move the pillowcase blank through a bottom end seaming station, broadly indicated at 90 in FIG. 1. The bottom end seaming station 90 includes a sewing machine 91 for stitching together the aligned bottom edges of the pillowcase blank as it is conveyed thereby. Suitable cutting means, not shown, is provided adjacent the sewing machine 91 to sever the stitch chain extending from the trailing edge of the bottom seam of the pillowcase blank.

A pickup rake member 94 is provided adjacent the ends of the conveyor belts 93 to move the sewn pillowcase blanks onto a counting and stacking station, broadly indicated at 95. The counting and stacking station 95 may be of the type illustrated in the copending application.

The details of the pulleys, guide rod supports, tension mechanisms, drive means for the various conveyor belts, and other mechanisms are not illustrated and described in detail, but are of conventional construction. Because such mechanisms are conventional and well understood by those with ordinary skill in the art, a detailed disclosure thereof is not necessary for a full understanding of the present invention. Also, the control mechanisms for sequentially controlling operation of the various stations of the apparatus, in timed relationship with each other, are not disclosed in detail since they are conventional and well understood by those with ordinary skill in the art and are not believed necessary for a full understanding of the present invention.

The pillowcase fabricating apparatus of the present invention operates to automatically form successive pillowcases from continuous open textile fabric. The folding over of the leading end portion of the pillowcase fabric transversely across the width of the fabric and onto the adjacent trailing portion before the textile fabric is cut permits accurate and concise positioning of the upper and lower layers of the pillowcase blank. After the folded pillowcase blank is cut from the leading end of the textile fabric, it is moved through the side and bottom seaming stations while the corresponding edges of the upper and lower layers are maintained in accurate alignment.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An apparatus for successively fabricating pillowcases with attached hems, said apparatus comprising a supply source of continuous open width textile fabric with side edges along opposite sides thereof and being of a width sufficient to form the length of a pillowcase, means for successively withdrawing predetermined lengths of the pillowcase fabric from said supply source and along a horizontal first path of travel in a lengthwise direction, a supply source of continuous textile fabric of a width sufficient to form a hem, a hem forming station including means for longitudinally folding the hem fabric and positioning the edge portions above and below one side edge of the pillowcase fabric as the pillowcase fabric is traveling lengthwise along said first path of travel, a hem stitching station including means for sewing the edge portions of the folded hem fabric to said one side edge of the pillowcase fabric, a folding station including means for receiving the leading end portion of the hemmed pillowcase fabric from said hem stitching station and folding the leading end portion transversely across the width of the pillowcase fabric and onto the trailing adjacent portion to form superposed upper and lower layers, a cutting station positioned in the longitudinal path of travel of the widthdrawn predetermined lengths of pillowcase fabric, said cutting station including cutting means for transversely cutting the hemmed pillowcase fabric adjacent the leading end of the folded-over upper layer of the pillowcase fabric to form individual pillowcase blanks, conveying means for successively moving the individual blanks along a horizontal second path of travel in a lengthwise direction from said cutting station, a side seaming station for receiving the overlying side edges and sewing together the folded hems and trailing side edges as the pillowcase blank is conveyed through said side seaming station, conveying means for successively moving the individual blanks along a third horizontal path of travel in a widthwise direction, and a bottom end seaming station for receiving and sewing together the overlying bottom ends as the pillowcase blank is conveyed through said bottom end seaming station.

2. An apparatus according to claim 1, including a counting and stacking station including means for receiving the successive pillowcases from said bottom end seaming station and positioning a predetermined number of said pillowcases in a stack.

3. An apparatus, according to claim 1, wherein said means for successively withdrawing predetermined lengths of the textile fabric comprises first feed roll means positioned adjacent said supply source and operable to withdraw predetermined lengths of the fabric from said supply source, second feed roll means positioned downstream of said hem forming station, third feed roll means positioned upstream of said cutter means, and fabric accumulator and tension means positioned between said second and third feed roll means for receiving and maintaining predetermined tension in the fabric.

4. An apparatus, according to claim 1, wherein said folding station comprises vertically reciprocating clamping plate means for engaging and clamping the trailing adjacent portion of the textile fabric, horizontally and vertically reciprocating folding plate means initially positioned below the level of said clamping plate means for receiving the leading end portion of the textile fabric in overlying relationship thereon, first operating means for vertically raising said folding plate means and the overlying leading end portion of the textile fabric above the level of said clamping plate means, and second operating means for horizontally moving said folding plate means into overlying relationship above said clamping plate means to position the leading end portion of the textile fabric in folded position overlying said clamping plate means.

5. Folding means, suitable for use in an apparatus for successively fabricating textile fabric articles, such as pillowcases and the like, including means for successively conveying predetermined lengths of textile fabric in a lengthwise direction with the leading end being positined in a predetermined location during such fabrication; the combination therewith of folding means positioned for successively receiving the leading end portion of the textile fabric and transversely folding the leading end portion of the textile fabric back over upon the trailing adjacent portion with opposite side edges of the folded over leading end portion in substantially overlying alignment with the opposite side edges of the trailing adjacent portion, said folding means comprising vertically reciprocating clamping plate means for engaging and clamping the trailing adjacent portion of the textile fabric, horizontally and vertically reciprocating folding plate means initially positioned below the level of said clamping plate means for receiving the leading end portion of the textile fabric in overlying relationship thereon, first operating means for vertically raising said folding plate means and the overlying leading end portion of the textile fabric above the level of said clamping plate means, and second operating means for horizontally moving said folding plate means into overlying relationship above said clamping plate means to position the leading end portion of the textile fabric in folded position overlying said clamping plate means.

6. In an apparatus for successively fabricating textile fabric articles, such as pillowcases and the like, including means for successively conveying predetermined lengths of textile fabric in a lengthwise direction with the leading end being positioned in a predetermined location during such fabrication; the combination therewith of folding means positioned for successively receiving the leading end portion of the textile fabric and transversely folding the leading end portion of the textile fabric back over upon the trailing adjacent portion with opposite side edges of the folded over leading end portion in substantially overlying alignment with the opposite side edges of the trailing adjacent portion, said folding means comprising vertically reciprocating clamping plate means for engaging and clamping the trailing adjacent portion of the textile fabric, horizontally and vertically reciprocating folding plate means initially positioned below the level of said clamping plate means for receiving the leading end portion of the textile fabric in overlying relationship thereon, first operating means for vertically raising said folding plate means and the overlying leading end portion of the textile fabric above the level of said clamping plate means, and second operating means for horizontally moving said folding plate means into overlying relationship above said clamping plate means to position the leading end portion of the textile fabric in folded position overlying said clamping plate means.

7. In an apparatus, according to claim 6, including conveying means for moving the respective leading end portion and the trailing adjacent portion of the textile fabric into positions above said folding plate means and below said clamping plate means.

8. In an apparatus, according to claim 7, wherein said conveying means comprises first conveyor belt means aligned beneath said clamping plate means, and second conveyor belt means aligned with said folding plate means.

9. In an apparatus, according to claim 8, including elongated slots spaced apart across the width of said folding plate means, and wherein said second conveyor belt means includes a plurality of spaced apart conveyor belts, each of said conveyor belts including an upper reach positioned in said elongated slots and extending slightly above the upper level of said folding plate means for engaging and moving the leading end portion of the textile fabric into overlying position with said folding plate means.

10. In an apparatus, according to claim 6, wherein said first operating means comprises a pair of operating cylinders connected to opposite side portions of said folding plate means and being operable to vertically raise and lower said folding plate means.

11. In an apparatus, according to claim 10, including a cross frame member supporting said pair of operating cylinders, and wherein said second operating means comprises an operating cylinder connected to said cross frame member and being operable to horizontally move said folding plate into and out of overlying relationship above said clamping plate means.

* * * * *